US007037243B1

(12) United States Patent
Clancy

(10) Patent No.: US 7,037,243 B1
(45) Date of Patent: May 2, 2006

(54) CORDLESS JUMP ROPE

(76) Inventor: Lester J. Clancy, P.O. Box 2694, 135 W. 5th St., Mansfield, OH (US) 44906

( * ) Notice: Subject to any disclaimer, the term of this patent is extended or adjusted under 35 U.S.C. 154(b) by 288 days.

(21) Appl. No.: 10/649,041

(22) Filed: Aug. 28, 2003

(51) Int. Cl.
*A63B 21/02* (2006.01)

(52) U.S. Cl. ..... 482/81

(58) Field of Classification Search ..... 482/108–10, 482/81, 82; 446/419–421
See application file for complete search history.

(56) References Cited

U.S. PATENT DOCUMENTS

| | | | | |
|---|---|---|---|---|
| 498,753 | A * | 5/1893 | Tucker | 482/82 |
| 1,010,015 | A | 11/1911 | Caddy | |
| 1,340,746 | A * | 5/1920 | Yungk | 446/421 |
| 3,415,515 | A | 12/1968 | Otto | |
| 4,179,119 | A | 12/1979 | Wolf | |
| 4,489,934 | A | 12/1984 | Miller | |
| 4,593,899 | A | 6/1986 | Miller | |
| 4,632,391 | A * | 12/1986 | Orak | 482/110 |
| 5,138,535 | A * | 8/1992 | Aragon, Jr. | 362/102 |
| 5,199,920 | A * | 4/1993 | Christen | 446/419 |
| 5,895,341 | A | 4/1999 | Jones | |
| 6,010,429 | A * | 1/2000 | Prueitt | 482/4 |
| 6,409,636 | B1 | 6/2002 | Risso et al. | |
| 6,514,179 | B1 * | 2/2003 | Yu | 482/44 |

* cited by examiner

*Primary Examiner*—Jerome Donnelly
(74) *Attorney, Agent, or Firm*—John D. Gugliotta

(57) ABSTRACT

An exercise apparatus is provided that simulates the effects of jumping rope, but does not utilize an actual rope. Two handles are provided similar in appearance to jump rope handles. At the end of the handle, where the rope would typically be, a donut-shaped enclosure is provided and mounted to the handle along its symmetrical axis. Inside of each donut-shaped enclosure, a weighted ball that rotates around a circular chamber within the enclosure. When rotated, the weighted balls generate rotational torque to simulate the use of a jump rope.

3 Claims, 3 Drawing Sheets

CORDLESS JUMP ROPE

RELATED APPLICATIONS

The present invention was first described in Disclosure Document Number 523,049 filed on Dec. 1, 2002 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to jump-rope exercisers and the like and, more particularly, to a jump-rope simulator incorporating rotatable, counterbalancing weights integrally within a handle.

2. Description of the Related Art

Physical fitness and health concerns are among the areas of highest concern among Americans today. More than ever, people are frequenting health clubs and performing exercise routines at home in order to lose weight, improve muscle tone and maintain a healthy lifestyle. One favorite tool of many who exercise is the jump rope. Jumping rope is a high-impact, high aerobic activity that develops cardiovascular and muscular endurance along with agility, coordination, and muscular strength. It can be done virtually anywhere and equipment costs are minimal. However, it does have some disadvantages. First it requires a high ceiling height to allow the rope to swing overhead. Second and perhaps most importantly, it requires some practice until one develops the coordination necessary to jump rope without becoming tangled in it. Only then can one derive the maximum workout and associated health benefits.

A search of the prior art did not disclose any patents that read directly on the claims of the instant invention; however, the following references were considered related:

| U.S. Pat. No. | Title |
|---|---|
| 5,895,341 | Jump rope simulator |
| 6,409,636 | Electronic jump rope |
| 4,593,899 | Exercise jumping rope |
| 4,489,934 | Exercise jumping rope |
| 4,179,119 | A skipping rope employing a wire rope and wooden handles |
| 3,415,515 | A fitness rope for use in both jumprope and stretching exercises |
| 1,010,015 | A fitness rope for use in both jumprope and stretching exercises |

Of considerable relevance is U.S. Pat. No. 5,895,341, issued in the name of Jones. While the '341 references provides a pair of handles that are separate and not connected by a tether, such a feature, incorporated into this invention in combination, other elements are different enough as to make the combination distinguished over this prior art.

Consequently, there is a need for means by which the health benefits associated with jumping rope can be obtained without the disadvantages as listed above.

SUMMARY OF THE INVENTION

It is therefore an object of the present invention to provide an improved jump-rope exerciser.

It is a feature of the present invention to provide an improved jump-rope exercisers comprised of a simulator incorporating rotatable, counterbalancing weights integrally within a handle.

Briefly described according to one embodiment of the present invention, an exercise apparatus is provided that simulates the effects of jumping rope, but does not utilize an actual rope. The invention takes the form of two handles, similar in appearance to jump rope handles. At the end of the handle, where the rope would typically be, a donut-shaped enclosure is provided and mounted to the handle along its symmetrical axis. Inside of each donut-shaped enclosure, a weighted ball or rotating gear system is provided. Additionally, a timer that keeps track of the total time that the invention is used is provided.

To use the invention, a user holds a handle in each hand, and begins to simulate jumping rope while moving the handles in a circle with their hands and arms. The weighted ball or gear simulates the centrifugal action of a jump rope, thus delivering all the health benefits of jumping rope without any of the disadvantages of stumbling on the rope, having the rope hit the ceiling or the like.

The use of the present invention provides health enthusiasts all of the benefits of jumping rope with none of the disadvantages in a manner, which is quick, easy and effective.

Advantages of the present invention is that is allows the user to move as if jumping rope, but does not use an actual rope. As such, it provides health benefits and aerobic exercise such as increase endurance and stamina.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the Figures.

1. Detailed Description of the Figures

Figure 1:
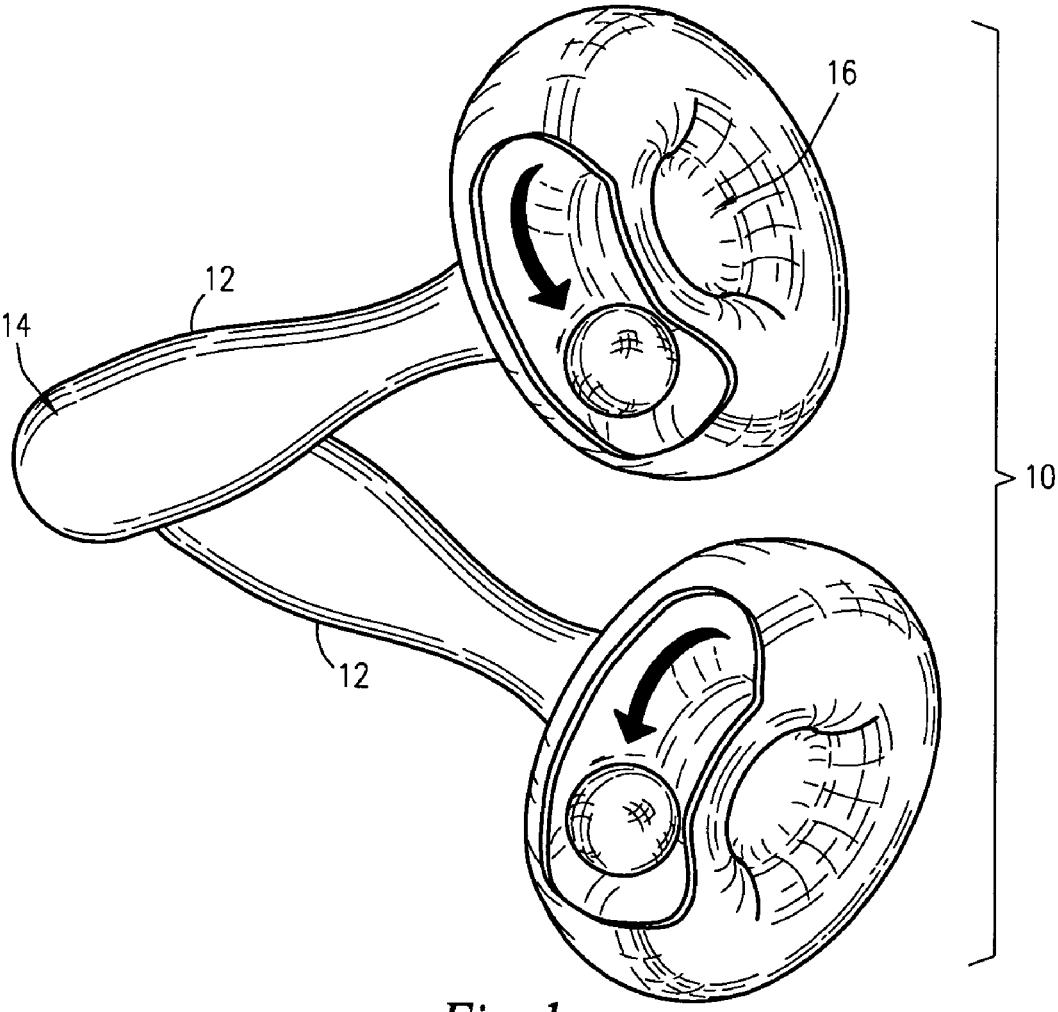
FIG. 1 is a partial cutaway perspective view of a pair of jump rope exerciser handles 12 used in the preferred embodiment of the present invention.
Figure 2:
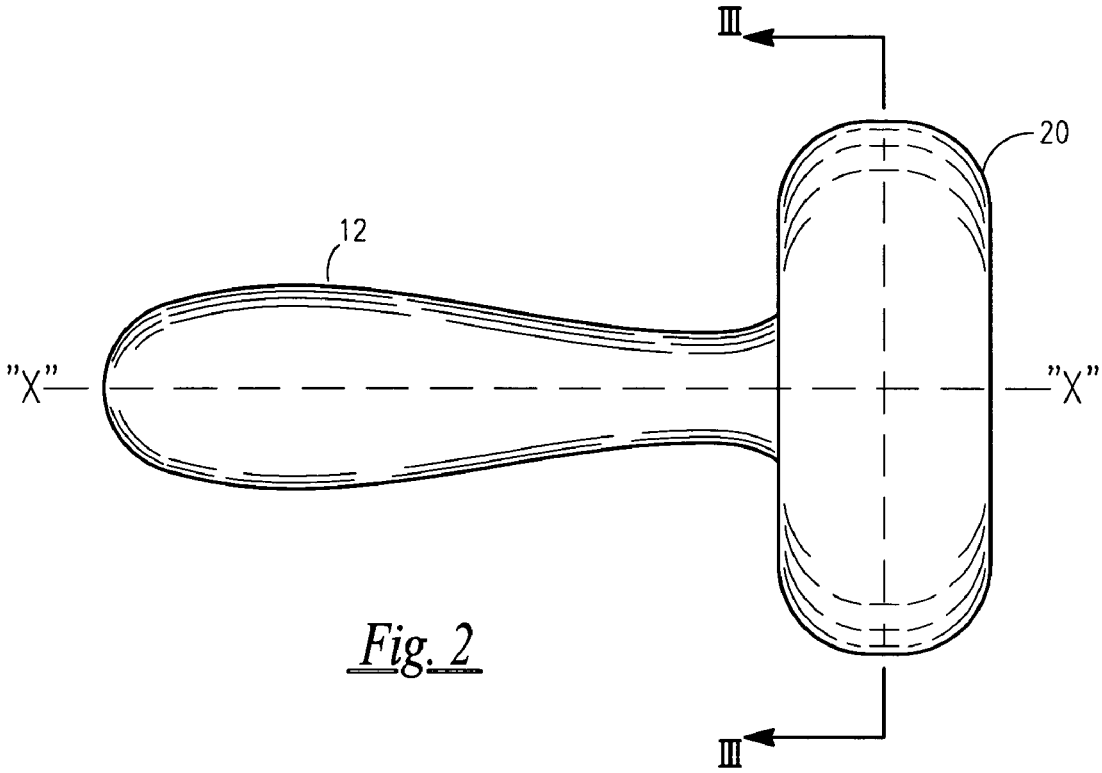
FIG. 2 is a side elevational view of one such handle 12.
Figure 3:
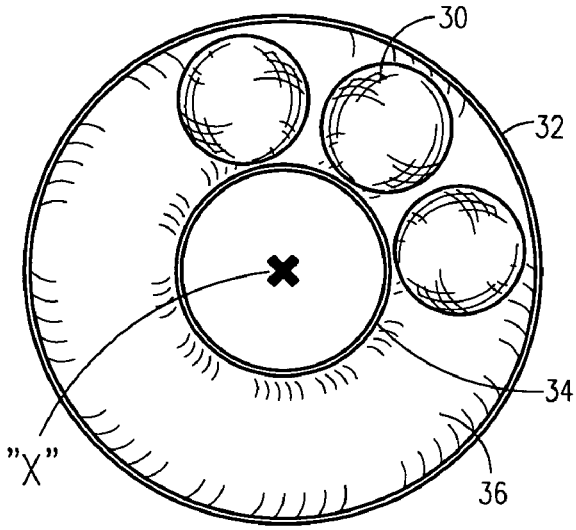
FIG. 3 is a cross sectional view taken along line III—III of FIG. 2.
Figure 4:
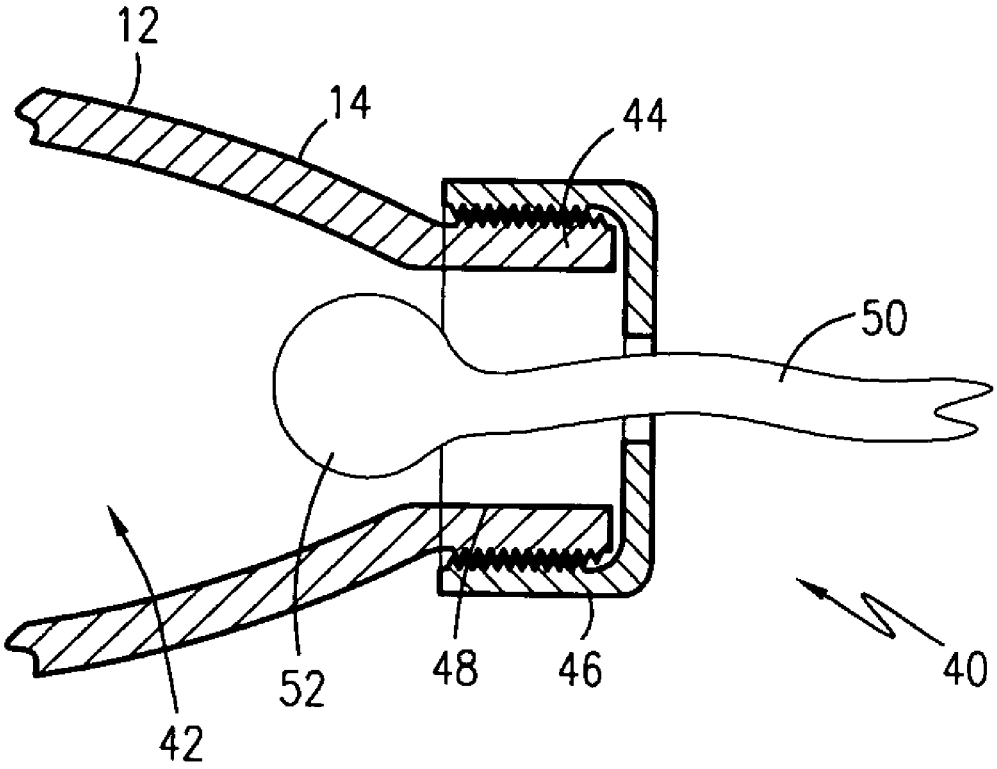
FIG. 4 is a partial cross sectional view of an alternate embodiment incorporating a flexible stretching exerciser/stretcher device therein.

Referring now to FIGS. 1–3, an exerciser apparatus 10 is shown, according to the present invention, comprising a pair of jump rope exerciser handles that simulates the effects of jumping rope, but does not utilize an actual rope. Each handle 12 is similar in appearance to jump rope handles forming a linearly elongated grasping member having a first end 14 opposite a second end 16 aligned along a symmetrically balanced central axis "X". At the first end 14 it is anticipated that a flexible stretching exerciser/stretcher device can be incorporated in combination with the exerciser apparatus 10, as will be described in greater detail below in accordance with FIG. 4. At the second end 16, where the rope would typically be, a donut-shaped enclosure 20 is provided and mounted to the handle along and perpendicular to its symmetrical axis X. Inside of each donut-shaped enclosure 20, a series of weighted balls 30 is provided. The enclosure 20 forms a circular outer sidewall 32 anularly separated from a circular inner sidewall 34. The outer sidewall 32 and inner sidewall 34 bound and form smooth inner channel 36 that retain and guide the weighted balls 30 such as to form a circular track perpendicular to and symmetrically about the centerline "X" of the handle.

Having described the basic cordless jump rope of the present invention, one skilled in the art can see that various additional features can be incorporated in combination to provide a broader adaptable exercise device. One such feature is shown in conjunction with FIG. 4, in which a partial cross sectional view of an alternate embodiment is shown incorporating a flexible stretching exerciser/stretcher device 40. To adapt such an improvement, the handle 12 forms a hollow chamber 42 and the first handle end 14 forms a chamber orifice 44 to provide access to the chamber 42. A threaded end cap 46 is threadably engaged with a threaded neck portion 48 to seal the hollow chamber 42. A length of linearly elongated, stretchable flex member 50, such as is conventionally used in stretching or isometric exercise devices, is retained at each end within the chamber 42 by terminated each end with an anchor means 52 and retaining one anchor means 52 within a chamber 42 of each handle 12. Depending upon the length and elastomeric characteristics selected for the flex member 50, the exerciser can now be used for stretching, warming up, or actual resistance isometric exercises.

Other improvements are anticipated. By way of example, and not as a limitation, a timer that keeps track of the total time that the invention is used can be incorporated within the handle 12 or enclosure 20. Or, in a similar fashion, a timer that keeps track of the total repetitions of simulated jump-rope use can be incorporated within the handle 12 or enclosure 20 as well.

2. Operation of the Preferred Embodiment

To use the invention, a user holds a handle in each hand, and begins to simulate jumping rope while moving the handles in a circle with their hands and arms. The weighted ball or gear simulates the centrifugal action of a jump rope, thus delivering all the health benefits of jumping rope without any of the disadvantages of stumbling on the rope, having the rope hit the ceiling or the like.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. An exerciser apparatus comprising:

a pair of jump rope exerciser handles that simulates the effects of jumping rope, each handle forming a linearly elongated grasping member having a first end opposite a second end aligned along a symmetrically balanced central axis;

at least one weighted ball;

a donut-shaped enclosure mounted to said handle along and perpendicular to said symmetrical axis said enclosure forming a circular outer sidewall annularly separated from a circular inner sidewall such that said outer sidewall and said inner sidewall bound and form smooth inner channel that retain and guide said weighted ball such as to form a circular track perpendicular to and symmetrically about said centerline of said handle; and a flexible stretching member attached at said first end, where said flexible stretching member retained at each end within said chamber by terminated each end with an anchor means and retaining one anchor means within a chamber of each said handle.

2. The exerciser of claim 1, further comprising a timer incorporated within said handle.

3. The exerciser of claim 1, further comprising:

a hollow chamber formed in said handle;

said first handle end forming a chamber orifice to provide access to said hollow chamber;

a threaded end cap threadably engaged with a threaded neck portion to seal the hollow chamber.

* * * * *